US011180913B2

(12) United States Patent
Baltz, Jr. et al.

(10) Patent No.: US 11,180,913 B2
(45) Date of Patent: Nov. 23, 2021

(54) TOP OF WALL VENTILATION SCREED DEVICE AND ASSEMBLY

(71) Applicant: Alabama Metal Industries Corporation, Birmingham, AL (US)

(72) Inventors: Gary George Baltz, Jr., Mountain Brook, AL (US); Frederic C. Mayer, Jr., Hoover, AL (US)

(73) Assignee: Alabama Metal Industries Corporation, Birmingham, AL (US)

( * ) Notice: Subject to any disclaimer, the term of this patent is extended or adjusted under 35 U.S.C. 154(b) by 175 days.

(21) Appl. No.: 16/194,718

(22) Filed: Nov. 19, 2018

(65) Prior Publication Data

US 2019/0161960 A1 May 30, 2019

Related U.S. Application Data

(60) Provisional application No. 62/592,614, filed on Nov. 30, 2017.

(51) Int. Cl.
*E04B 1/70* (2006.01)
*E04F 13/06* (2006.01)
(Continued)

(52) U.S. Cl.
CPC ..... *E04B 1/7076* (2013.01); *E04F 13/007* (2013.01); *E04F 13/068* (2013.01); *E04D 13/152* (2013.01); *F24F 7/10* (2013.01)

(58) Field of Classification Search
CPC .... E04B 1/7076; E04F 13/007; E04F 13/068; E04D 13/152; F24F 7/10
(Continued)

(56) References Cited

U.S. PATENT DOCUMENTS 1,676,582 A 7/1928 Stuart
2,245,965 A 6/1941 Hyman
(Continued)

FOREIGN PATENT DOCUMENTS

AU 2008202082 A1 11/2008
AU 2008202082 A1 11/2008
(Continued)

OTHER PUBLICATIONS

From U.S. Appl. No. 15/446,732—cited as "Prior Art Weep Screed from Google Search 1 page: dated 2004".
(Continued)

*Primary Examiner* — Allen R Schult
(74) *Attorney, Agent, or Firm* — Honigman LLP

(57) ABSTRACT

A ventilation screed comprising: a perforated attachment flange portion that is substantially vertical and has a top end and a bottom end and at least one perforation between the top end and the bottom end; a three sided cavity portion having a first side that is substantially horizontal having a left portion and a right portion, a second side that is substantially vertical having a top portion and a bottom portion and the top portion is in communication with the left portion of the first side at a substantially 90 degree angle to the first side and a third side that is between the bottom portion of the second side and the top end of the perforated attachment flange portion at an angle that slopes downwardly, wherein the third side has at least one ventilation opening; and a ventilation spacer along an underside of the three sided cavity portion.

19 Claims, 13 Drawing Sheets

(51) Int. Cl.
*E04F 13/00* (2006.01)
*E04D 13/152* (2006.01)
*F24F 7/10* (2006.01)

(58) Field of Classification Search
USPC ..... 454/276
See application file for complete search history.

(56) References Cited

U.S. PATENT DOCUMENTS

D151,022 S 9/1948 Weber et al.
D164,420 S 9/1951 Hodgman
D164,421 S 9/1951 Hodgman
2,645,824 A * 7/1953 Titsworth ..... E04B 1/7069 52/302.3
2,664,057 A * 12/1953 Ausland ..... E04D 13/1415 52/61
3,206,806 A 9/1965 Powell
3,343,323 A 9/1967 Mayfield
3,568,391 A 3/1971 Conway
D249,164 S 8/1978 Grant
4,924,647 A 5/1990 Drucker
5,423,154 A 6/1995 Maylon et al.
5,579,617 A 12/1996 Schiedegger
5,630,297 A 5/1997 Rutherford
5,694,723 A 12/1997 Parker
5,699,638 A 12/1997 Maylon
5,809,731 A 9/1998 Reiss
5,836,135 A 11/1998 Hagan et al.
6,018,924 A 2/2000 Tamlyn
6,119,429 A 9/2000 Bifano
6,293,064 B1 9/2001 Larson
6,298,609 B1 10/2001 Bifano
6,308,470 B1 10/2001 Durkovic
6,385,932 B1 5/2002 Melchiori
D459,007 S 6/2002 Campacci
6,410,118 B1 6/2002 Reicherts
6,470,638 B1 10/2002 Larson
D471,991 S 3/2003 Maylon et al.
D477,420 S 7/2003 Butcher
6,792,725 B1 9/2004 Rutherford
6,823,633 B2 11/2004 Ryan
6,988,345 B1 1/2006 Pelfrey
7,219,477 B2 5/2007 Leffler
7,487,623 B2 2/2009 Rodolofo
7,546,719 B1 6/2009 Guevara
7,584,587 B2 9/2009 Ouellette
7,621,079 B2 11/2009 Kyozaburo
7,634,883 B1 12/2009 Larson
D618,825 S 6/2010 Johnson
7,743,575 B2 6/2010 Ito
D624,212 S 9/2010 Sawyer
7,810,291 B2 10/2010 McPherson
8,281,530 B2 10/2012 Chaussee
8,578,660 B2 11/2013 Nolan
8,584,416 B2 11/2013 Chenier
8,596,019 B2 12/2013 Aitken
8,646,222 B2 2/2014 Carbonaro
D700,717 S 3/2014 Campacci
D703,306 S 4/2014 Little
D703,307 S 4/2014 Little
8,726,594 B2 5/2014 Salazar
8,813,443 B2 8/2014 Goldberg
8,919,062 B1 12/2014 Viness
8,943,761 B2 2/2015 Carbonaro
9,140,008 B2 9/2015 Fischer
D740,968 S 10/2015 Stanfill
9,366,040 B2 6/2016 Singh
D761,971 S 7/2016 Apanovich et al.
D762,310 S 7/2016 Apanovich
D787,091 S 5/2017 Singh
D792,609 S 7/2017 Smith et al.
D800,344 S 10/2017 Apanovich
D800,921 S 10/2017 Apanovich
D814,057 S 3/2018 Singh
D815,757 S 4/2018 Braun
D817,518 S 5/2018 Singh
10,024,063 B2 7/2018 Friel
D842,496 S 3/2019 Apanovich
D888,285 S 6/2020 Baltz, Jr. et al.
D893,051 S 8/2020 Baltz, Jr. et al.
10,731,335 B2 8/2020 Baltz, Jr. et al.
D896,993 S 9/2020 Baltz, Jr. et al.
D902,443 S 11/2020 Baltz, Jr.
D903,146 S 11/2020 Baltz, Jr. et al.
D904,649 S 12/2020 Maldonado et al.
2003/0126810 A1 7/2003 Brunson
2003/0177736 A1 9/2003 Gatherum
2005/0115189 A1 6/2005 Leffler
2006/0123723 A1 6/2006 Weir
2006/0199505 A1* 9/2006 Fettkether ..... F24F 13/0218 454/232
2006/0277854 A1 12/2006 Egan
2007/0044402 A1 3/2007 Hess
2007/0130861 A1 6/2007 Chenier
2007/0256386 A1 11/2007 Ito
2008/0104918 A1 5/2008 Gleeson
2008/0148672 A1 6/2008 Monteer
2008/0220714 A1* 9/2008 Caruso ..... F24F 7/02 454/365
2008/0263971 A1 10/2008 Maziarz
2009/0173858 A1 7/2009 LaCerte
2009/0183453 A1 7/2009 Koessler
2010/0101168 A1 4/2010 Hohmann
2010/0287861 A1 11/2010 Goldberg
2011/0252731 A1 10/2011 Boyer
2011/0302863 A1 12/2011 Sourlis
2012/0066984 A1 3/2012 Thompson
2012/0066986 A1 3/2012 Thompson
2013/0104481 A1 5/2013 Urban, Jr. et al.
2013/0125487 A1 5/2013 Power
2015/0013257 A1 1/2015 Power
2015/0027074 A1 1/2015 Preston
2016/0069071 A1 3/2016 Remmele
2016/0168869 A1 6/2016 Curtis et al.
2016/0340908 A1 11/2016 Apanovich
2017/0030072 A1 2/2017 Corson
2017/0226732 A1 8/2017 Collins
2017/0254091 A1 9/2017 Friel
2018/0112414 A1* 4/2018 Maziarz ..... E06B 1/62
2018/0305921 A1 10/2018 Margalit
2019/0136549 A1* 5/2019 Maziarz ..... E04F 19/061
2019/0161960 A1 5/2019 Baltz, Jr.
2019/0194954 A1 6/2019 Baltz, Jr.
2019/0292791 A1 9/2019 Friel
2019/0368190 A1 12/2019 Stender
2020/0063432 A1 2/2020 Baltz, Jr.
2020/0063446 A1 2/2020 Baltz, Jr.
2020/0157798 A1 5/2020 Baltz, Jr. et al.

FOREIGN PATENT DOCUMENTS

CA 2777166 A1 11/2012
CA 2777166 C 8/2019
CA 2983532 C 3/2021
JP 06330571 11/1994
JP 2657037 B2 9/1997
JP 2657037 B2 9/1997
JP 10037321 2/1998
JP 11131611 5/1999
JP 11131611 A 5/1999
JP 2008196248 8/2008
JP 2008196248 A 8/2008
JP 4490340 B2 6/2010
JP 4490340 B2 6/2010
JP 5968618 8/2010
JP 2011169094 A 9/2011
JP 2011169094 A 9/2011
JP 5002275 8/2012
JP 5002275 B2 8/2012
JP 2012202177 10/2012
JP 2012202177 A 10/2012
JP 2014218814 11/2014
JP 2014218814 A 11/2014

(56) References Cited

FOREIGN PATENT DOCUMENTS

| | | | |
|---|---|---|---|
| JP | 5968618 | B2 | 8/2016 |
| WO | 2016040273 | A1 | 3/2016 |
| WO | WO2016040273 | | 3/2016 |

OTHER PUBLICATIONS

From U.S. Appl. No. 15/446,732—cited as "Images of J-Bead believed to have been known in the art prior to Mar. 1, 2016".

* cited by examiner (132)

(134)

(136)

TOP OF WALL VENTILATION SCREED DEVICE AND ASSEMBLY

TECHNICAL FIELD

The present disclosure generally relates to a device configured to allow ventilation and the escape of water or other moisture, typically in the form of vapor at the top of a building or wall structure.

BACKGROUND

For purposes of the foregoing specification and appended claims the term "vapor," whether or not accompanied by any words such as "moisture," "water" or other words describing similar matter or states of matter, refers to all forms of liquid and gases not limited to water, water vapor, moisture as created by any means.

This invention addresses the condition that walls hold vapor and moisture and their inability to allow vapor and moisture to escape so the wall can dry is a major factor in the premature deterioration of a structure. Building science, construction practices and emerging energy codes have changed greatly over recent decades resulting in significantly better insulated walls. Consequently these newer wall designs allow less means for vapor and moisture to escape and less air flow. This has led to increasingly premature deterioration of walls of buildings and structures.

Established wall designs and construction are intended to keep water out of walls but not necessarily to allow them to breathe. Building wraps traditionally prevent water intrusion but do not let moisture out. A better wall design must allow for moisture and vapor to move through a predetermined path depending upon when the inside and outside temperatures have the sufficient temperature difference to create and hold excess moisture.

Further, air pressure differential from inside and outside the wall due to temperature and or wind can force moisture into the wall through the wall's surface, in addition preventing vapor and moisture from escaping. This prevents condensation from escaping and inhibits drying. Further, when cold air contacts hot air, or vice versa, condensation occurs and moisture is formed inside the walls of buildings and structures.

As a result, moisture and water accumulates without a means to escape causing the sheathing of walls to absorb moisture. Plywood, cement board, or OSB (Oriented Strand Board), which is more prone to absorb moisture can begin to mold, deteriorate, rot and hold more water. As the sheathing fails the weight of the finish material will begin to crack. This allows more moisture accumulation in the walls. Ultimately the finish material can fall away from the building or structure. Areas receiving 20-inches or more of rain a year are the most susceptible to this type of deterioration.

Designs currently available only use casing beads for the top of walls of a structure or a building. The current art does not facilitate the ventilation of a primary drainage cavity or the drying of the inside of the wall. Some of these areas of concern are at the top of full height walls and step walls, changes in roofline where a vertical element terminates into a non-vertical structure such as a dormer and roof for the removal of vapor from the top of the wall. In areas as noted above where greater rainfall is typical a more defined escape means for vapor and moisture is required over current methods.

Current commercially available accessories for stucco, stone and other finishes do not address these conditions and constraints on air and vapor flow throughout a wall. Therefore a new wall design and trim accessories are necessary to accommodate the different forms and function of the building envelope and prevent premature deterioration of the walls.

SUMMARY OF THE INVENTION

In one embodiment, a ventilation screed is provided comprising: a perforated attachment flange portion that is substantially vertical and has a top end and a bottom end and at least one perforation between the top end and the bottom end; a three sided cavity portion having a first side that is substantially horizontal having a left portion and a right portion, a second side that is substantially vertical having a top portion and a bottom portion and the top portion is in communication with the left portion of the first side at a substantially 90 degree angle to the first side and a third side that is between the bottom portion of the second side and the top end of the perforated attachment flange portion at an angle that slopes downwardly from the top end of the perforated attachment flange to the bottom portion of the second side, wherein the third side has at least one ventilation opening; and a ventilation spacer along an underside of the third side of the three sided cavity portion.

In another embodiment, a ventilation screed assembly is provided, comprising: at least two ventilation screeds having a perforated attachment flange portion that is substantially vertical and has a top end and a bottom end and at least one perforation between the top end and the bottom end; a three sided cavity portion having a first side that is substantially horizontal having a left portion and a right portion, a second side that is substantially vertical having a top portion and a bottom portion and the top portion is in communication with the left portion of the first side at a substantially 90 degree angle to the first side and a third side that is between the bottom portion of the second side and the top end of the perforated attachment flange portion at an angle that slopes downwardly from the top end of the perforated attachment flange to the bottom portion of the second side, wherein the third side has at least one ventilation opening; and a ventilation spacer along an underside of the third side of the three sided cavity portion; and a connector between two adjacent ventilation screeds.

BRIEF DESCRIPTION OF THE DRAWINGS

In the following section, the present disclosure will be described with reference to exemplary embodiments illustrated in the figures, in which.

DETAILED DESCRIPTION

In the following detailed description, numerous specific details are set forth in order to provide a thorough understanding of the disclosure. However, it will be understood by those skilled in the art that the present disclosure may be practiced without these specific details. In other instances, well-known methods, procedures, components and layouts have not been described in detail so as not to obscure the present disclosure.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" or "according to one embodiment" (or other phrases having similar import) in various places throughout this specification are not necessarily all referring to the same embodiment. Furthermore, the particular features, structures, or characteristics may be combined in any suitable manner in one or more embodiments. Also, depending on the context of discussion herein, a singular term may include its plural forms and a plural term may include its singular form. Similarly, a hyphenated term may be occasionally interchangeably used with its non-hyphenated version, and a capitalized entry may be interchangeably used with its non-capitalized version. Such occasional interchangeable uses shall not be considered inconsistent with each other. It is noted that various figures (including component diagrams) shown and discussed herein are for illustrative purpose only, and are not drawn to scale.

Figure 1:
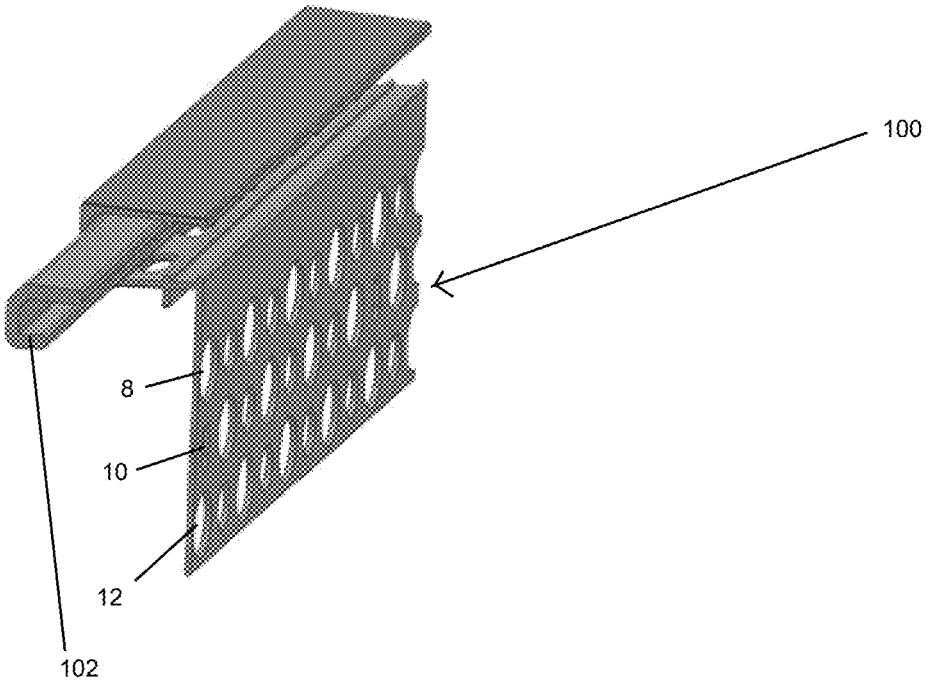
FIG. 1 depicts an isometric view of the present invention.
Figure 11:
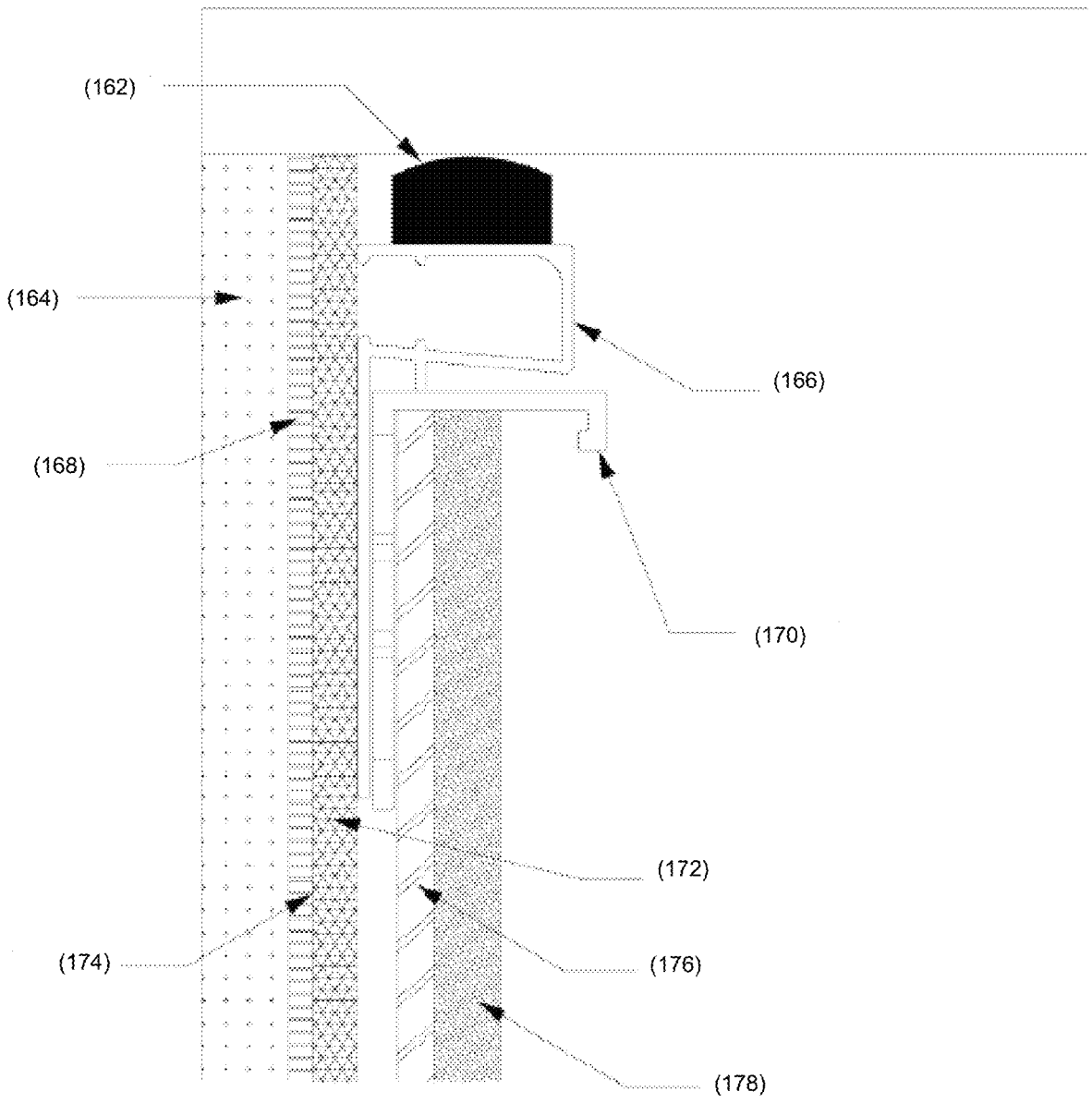
FIG. 11 depicts the present invention as installed.
Figure 12:
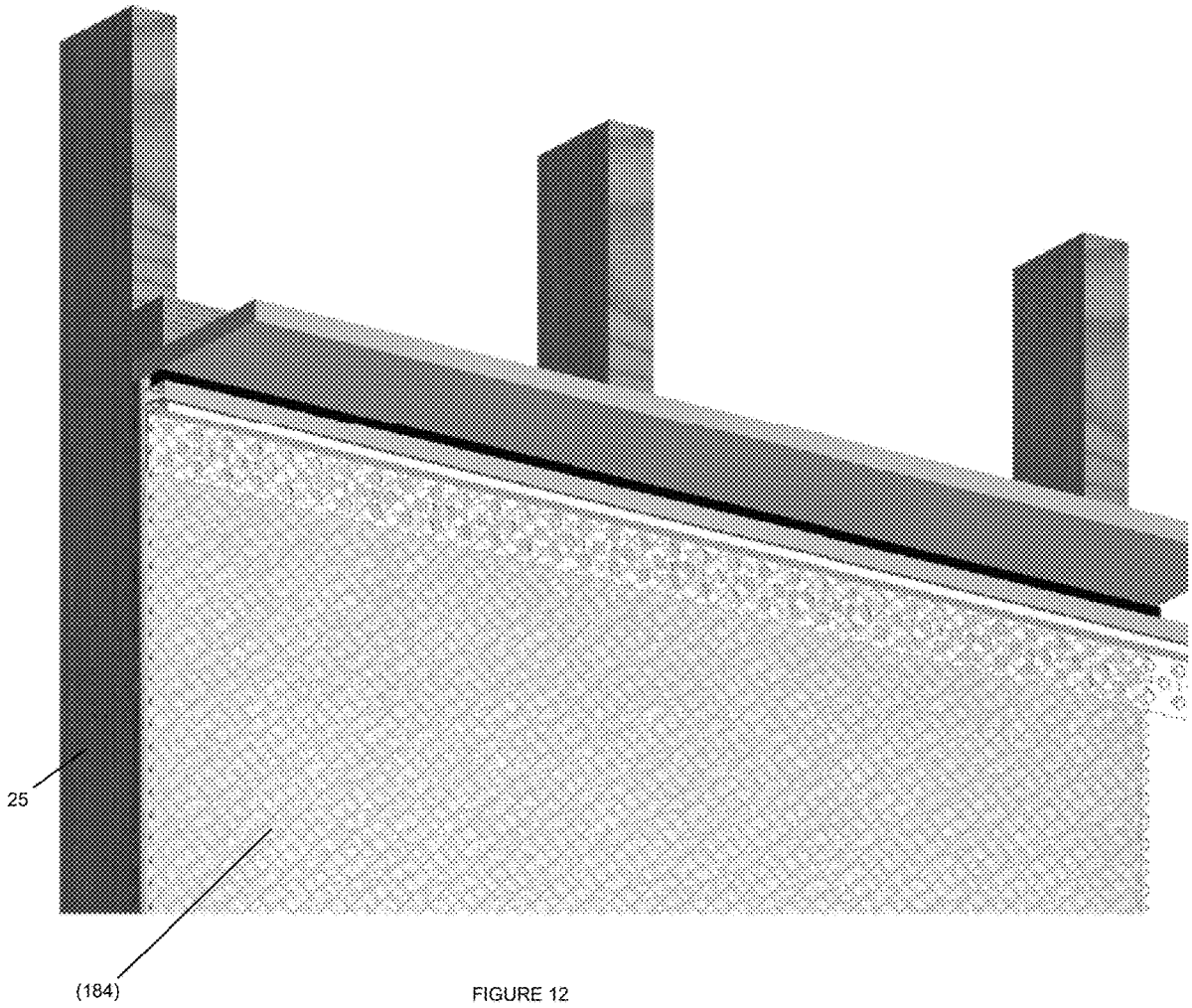
FIG. 12 depicts the present invention as installed.
Figure 13:
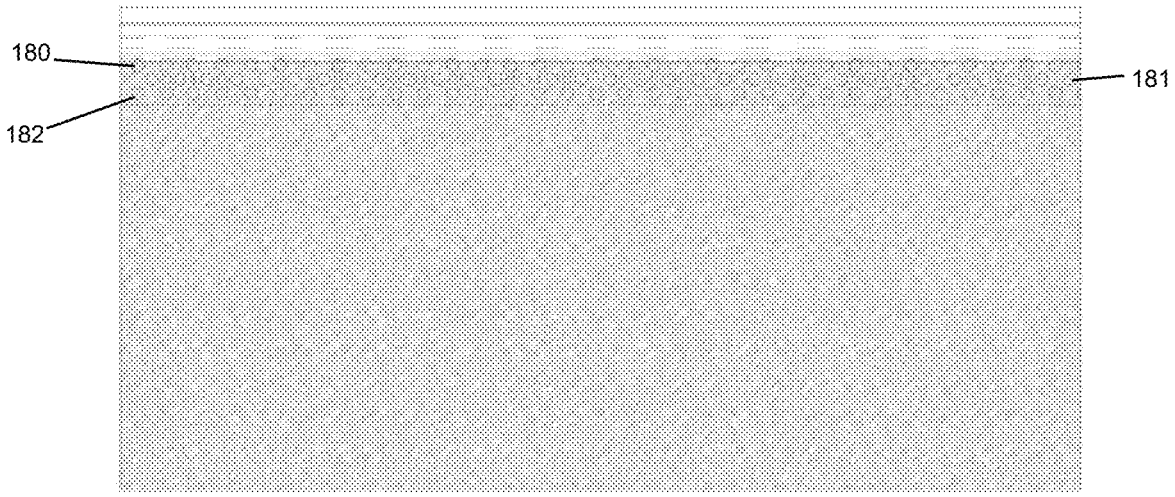
FIG. 13 depicts the present invention as installed.
Figure 14:
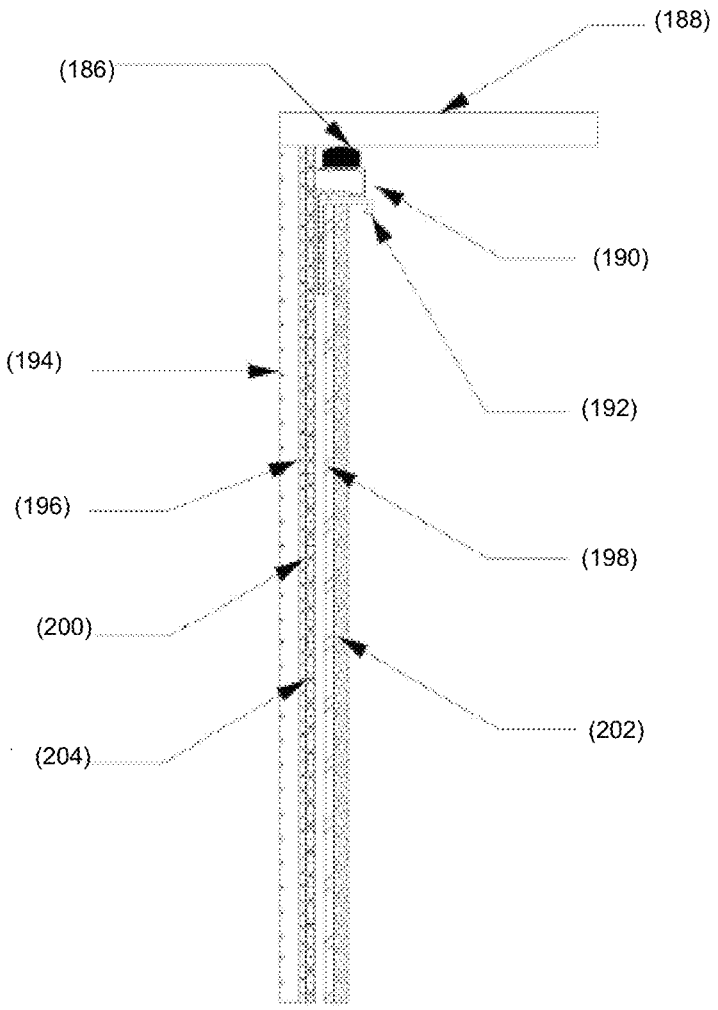
FIG. 14 depicts the present invention as installed.
Figure 15:
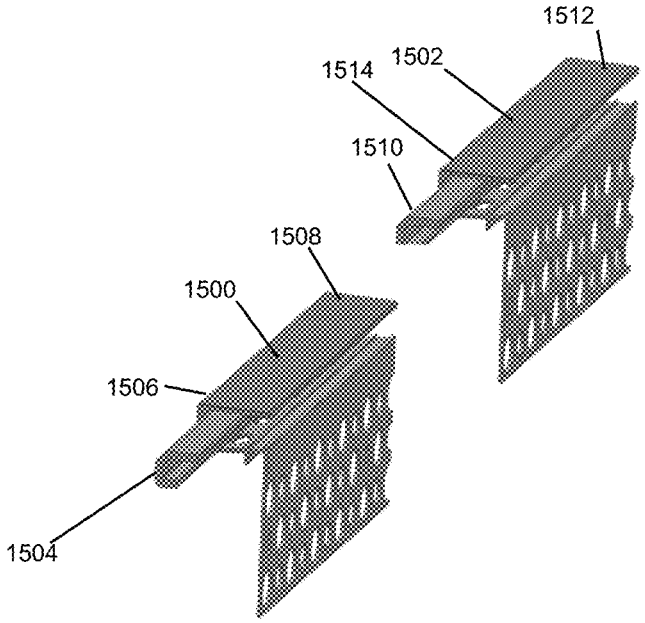
FIG. 15 depicts the present invention utilizing a joint connector.

Turning to FIGS. 1-14, the present invention is a ventilation screed (100) having: a perforated attachment flange portion (112) that is substantially vertical and has a top end (111) and a bottom end (113) and at least one perforation (185) between the top end (111) and the bottom end (113). The at least one perforation (185) of the perforated attachment flange portion may be three rows of circular openings (8, 10, 12). As depicted in FIG. 1, there may be a row of alternating larger openings and smaller openings and each row may be offset from the row below it. For example, as shown in FIGS. 1 and 12, a larger opening of one row (8) may be above a smaller opening of the row below it (10). The three sided cavity portion (106) has a first side (2) that is substantially horizontal having a left portion (101) and a right portion (99), a second side (4) that is substantially vertical having a top portion (103) and a bottom portion (105) and the top portion (103) is in communication with the left portion (101) of the first side (2) at a substantially 90 degree angle to the first side (2) and a third side (6) that is between the bottom portion (105) of the second side (4) and the top end (111) of the perforated attachment flange portion (112) at an angle that slopes downwardly from the top end (111) of the perforated attachment flange (112) to the bottom portion (105) of the second side (4), wherein the third side (6) has at least one ventilation opening (108); and a ventilation spacer (110) along an underside of the third side (6) of the three sided cavity portion. A portion of the ventilation spacer (110) and a portion of the perforated attachment flange portion (112) are in communication with a casing bead (128). It is noted that the casing bead (128) is not part of the invention, but the ventilation screed as installed is in communication with it. There may be a joint connector at a connection of at least one of the first side and the second side, the second side and the third side and the third side and the perforated attachment flange portion. FIG. 15 depicts an example of two side by side ventilation screeds (1500 and 1502) with two joint connectors (1504 and 1510). As can be seen the first joint connector (1504) sits in the drainage cavity along the left side (1506) of ventilation screen (1500). The second joint connector (1510), once connected, would sit in the right side (1508) of the ventilation screen (1500). In this way, the second ventilation screed (1502) would be connected to the first ventilation screed (1500). FIG. 15 depicts an exploded unconnected view of the two side by side ventilation screeds. As can be seen the joint connector in this example is J-shaped. This allows for stability while not blocking the ventilation openings. As can be seen, multiple joint connectors are used between adjacent ventilation screeds to line them up and provide additional stability.

There may be a connector (102) between two adjacent ventilation screeds (100). FIG. 1 depicts a single ventilation screed, a person of ordinary skill in the art would understand another ventilation screed is placed adjacent to the ventilation screed (100) shown and the connector would sit in the drainage cavity (106) of two adjacent ventilation screeds to facilitate straight, true and continuous installation of the invention. The connector (102) is a three sided connector that is smaller than the three sided cavity portion (106) and sits in the three sided cavity portion (106) to connect a first ventilation screed (100) to a second adjacent ventilation screed (not shown, would be identical to the first ventilation screed (100) to the left of it. The connector (102) sits between the two adjacent ventilation screeds.

There may be a moisture seal (e.g. 132, 134, 136, 138) attached to the left portion (101) of the first side (2) along a top portion of the first side. There may also be a screen (184) parallel to at least a portion of the perforated attachment flange portion (112). FIGS. 11-14 depict the ventilation screed (190) as installed. As shown in FIG. 11, a gasket (162) is under a soffit, the ventilation screed (190) is under the gasket (162) and above a casing bead (170). The environment as installed has sheathing (164), building wrap (168), reticulated foam or "greenscreen" (172), grade D paper (174), lath (176) and stucco or siding (178). The insect screen (106) could be reticulated foam, it could be an unwoven polymer such as cellulose, nylon or spun polypropylene fiber, or it could be even a nylon or polypropylene screen, although that would be less durable. There may be "Green Screen™", or another rain screen or solid or corrugated furring strips to the right of the ventilation screed (190), then lath and brick or stone veneer. The "Green Screen™", or another rain screen or solid or corrugated furring strips may be installed parallel to and between siding and the perforated attachment flange portion (112). There may also be a screen (184) vertical and perpendicular to at least a portion of the perforated attachment flange portion (112). There may also, or alternatively, be a mesh vertical and perpendicular to at least a portion of the perforated attachment flange portion. There may also be reticulated foam (which may be in the same location as the rain screen or solid or corrugated furring strips (112)) to the right of the ventilation screed, then lath and brick or stone veneer. The reticulated foam insert may be installed parallel to the siding. The term "greenscreen" refers to a polypropylene entangled mesh, but it could also be described as a polymer strand matrix with a dimple structure. The Greenscreen™ provides a drainage path and ventilation for moisture between the exterior wall finish and sheathing. It is a polymer strand matrix with a unique dimple design that exhibits superior compressive strength. When installed according to the present invention is allows over 99% of moisture and vapor to drain and escape from the wall. There may also be a screen parallel to at least a portion of the perforated attachment flange portion. There may also, or alternatively, be a mesh parallel to at least a portion of the perforated attachment flange portion. A shown, in FIG. 14, there may be a ventilation screed (190) with a moisture seal that is a gasket (186) between the ventilation screed (190) and a soffit (188) of a building. The optional "gasket" is provided to assist in getting a superior, and depending on the design of the gasket moveable, moisture barrier at the juncture of vertical and horizontal surfaces such as a soffit, or between the finish and a window or door jamb or whatever through wall penetration is required, such as but not limited to hose bib or louvered vent or vent shroud. The ventilation screed (190) is in communication with a casing bead (192). The building may have sheathing (194), building wrap (196), grade D paper (200) and a reticulated foam insert (204) that may be a "greenscreen." There may be lath (198) and stucco or siding (200). A screen (184) or mesh may be under the lath (198). The reticulated foam insert (204), as installed, may be parallel to and between a wall (25) and the perforated attachment flange portion (112).

Figure 2:
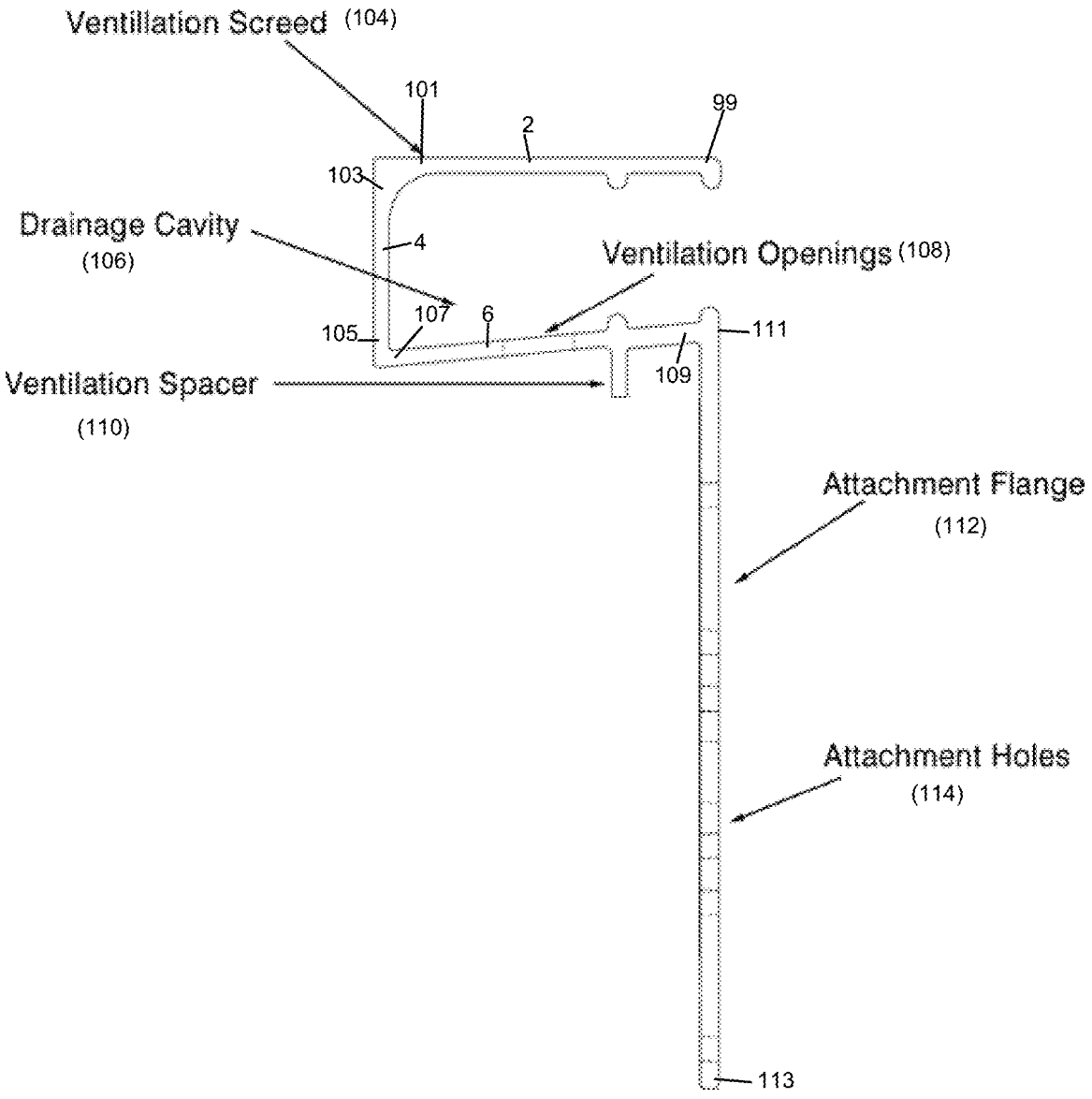
FIG. 2 depicts a side view of the present invention with labeling.
Figure 3:
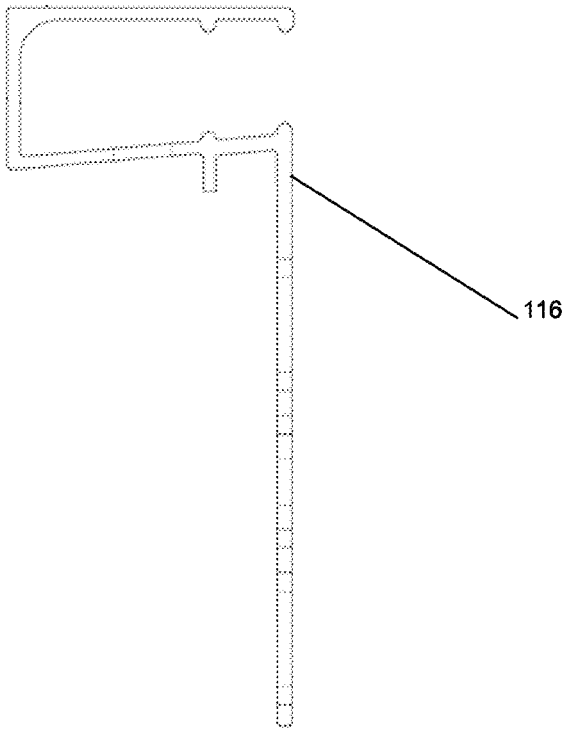
FIG. 3 depicts a side view of the present invention without labels.
Figure 4:
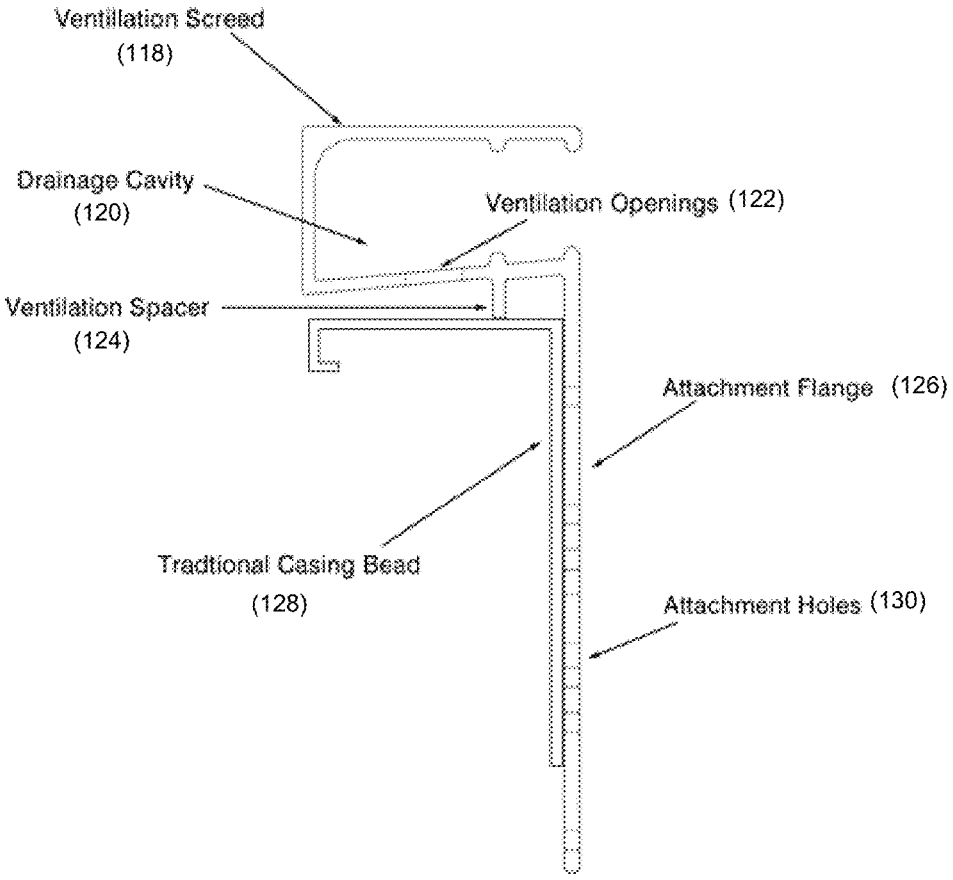
FIG. 4 depicts a side view of the present invention shown with nested, standard casing bead and labeled.
Figure 5:
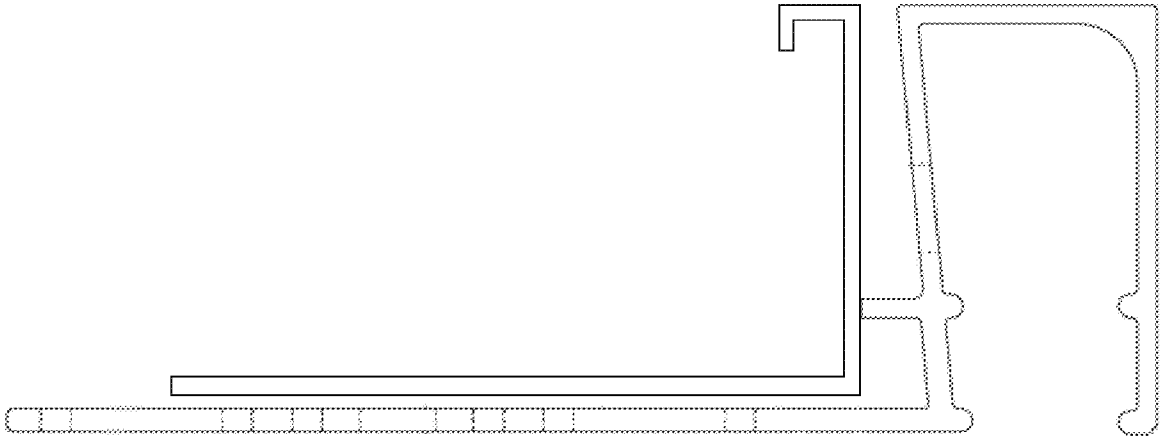
FIG. 5 depicts a side view of the present invention shown with nested, standard casing bead without labels.
Figure 6:
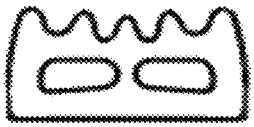
FIG. 6 depicts examples of water seals according to the present invention.
Figure 6:
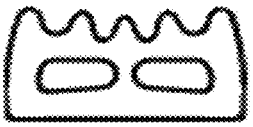
Figure 6:
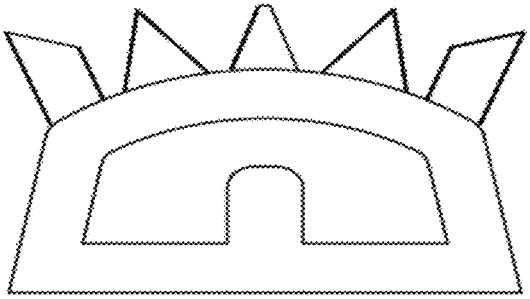
Figure 7:
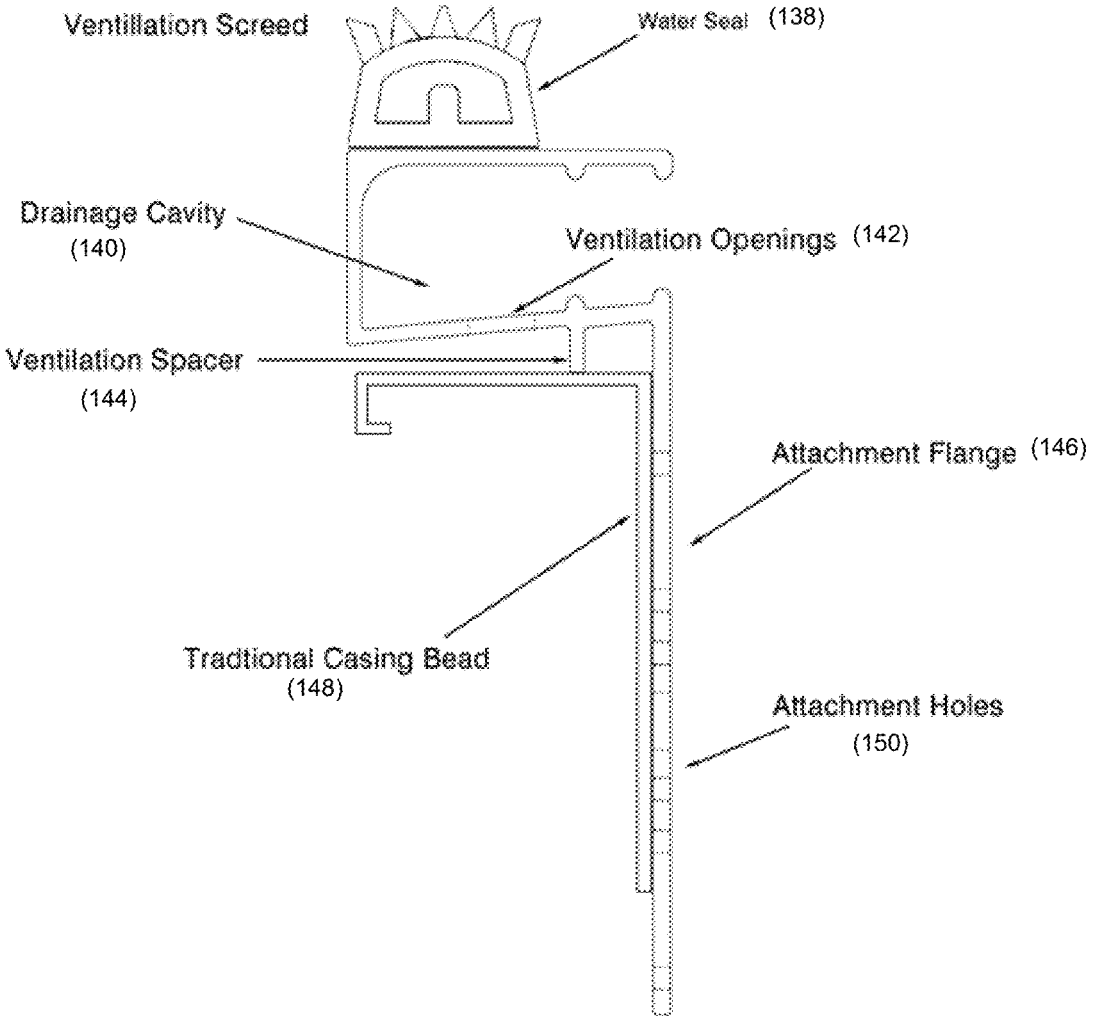
FIG. 7 depicts a side view of the present invention using a water seal with labeling.
Figure 8:
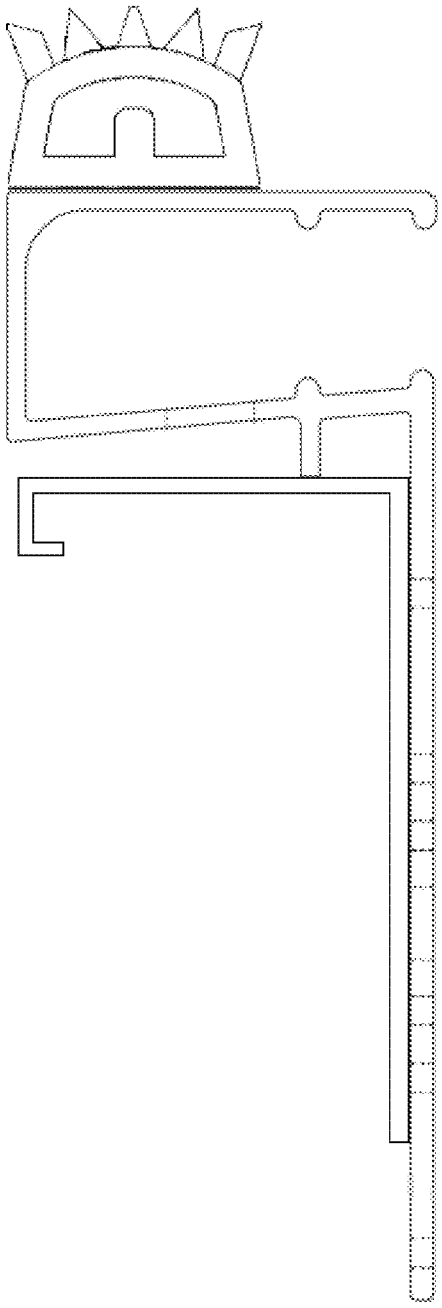
FIG. 8 depicts a side view of the present invention using a water seal without labeling.
Figure 9:
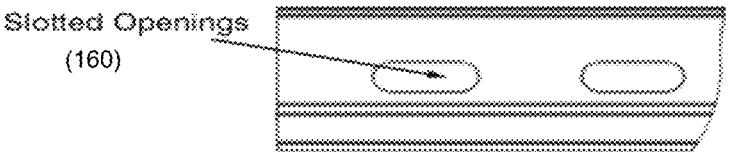
FIG. 9 depicts a front view of the present invention depicting a slotted opening with labeling.
Figure 10:
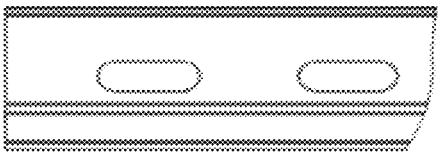
FIG. 10 depicts a front view of the present invention depicting a slotted opening without labels.

FIG. 4 depicts the present invention as installed in relation to a traditional casing bead (128). There is a ventilation screed (118) having a drainage cavity (120) and ventilation openings (122), a ventilation spacer (124), an attachment flange (126) with attachment holes (130). According to one aspect of the present invention, a ventilation screed assembly is provided. This is to say multiple ventilation screeds installed on a wall that are connected by the connector. The invention is a device configured to allow ventilation and the escape of water or other moisture in the form of vapor at the top of a building or structure wall. The various embodiments of this invention create a path for ventilation and drying of walls from the inside out. One preferred embodiment includes a perforated drainage cavity within the lower piece of the ventilation screed allowing the path for moisture and vapor to move up and out of the wall following a primary drainage plane such as a rainscreen. Another embodiment includes a spacer stop to maintain a consistent opening for ventilation between the drainage cavity formed by the ventilation screed and the optional, additional mechanism to terminate the stucco or other cladding material, e.g. a standard casing bead. Another embodiment includes a moisture seal, e.g. a gasket, at the juncture of vertical and horizontal surfaces such as a soffit. FIG. 6 depicts examples of gaskets (132, 136 and 136). Depending upon the rigidity of the water seal, the water seal provides water resistance and can allow minimal movement of the cladding of the wall. The device can be used for any exterior walls, but is not limited to use, in stucco systems, manufactured stone, and continuous rigid thermal insulation over the structure's wall substrate of the buildings wall design. The present invention overcome the problems of moisture escaping from the top of a wall as will be apparent to those skilled in the art of building cladding. As vapor is accumulated within a wall the flow of vapor can move by gravity or convection created by temperature, pressure or intrusion from outside the wall system. As temperature or pressure causes vapor to move to the top of the wall, this invention allows moisture and vapor to escape. Traditionally a casing bead has been used to terminate stucco at the top of a wall. Using just a casing bead, however, does not permit ventilation or drying of the wall. According to one embodiment an attachment flange with openings for nailing or other attachment means is provided. In one embodiment conjoined with a standard casing bead the termination of stucco and the ventilation of the wall can be accomplished. According to another embodiment a semi-rigid gasket with multiple shaped protuberances on top of the ventilation screed provides a snug and water resistant juncture of the invention and adjoining surfaces such as a soffit. According to another embodiment a flexible gasket with multiple shaped protuberances on top of the ventilation screed provides a water resistant juncture and allows minimal movement applied to the stucco panel or other cladding through lateral and compressive stresses. By introducing a primary drainage plane such as a rainscreen, vapor and moisture can rise and escape from behind the attachment flange through the drainage cavity through a plurality of openings in the bottom of the drainage cavity. Vapor and moisture will ultimately escape out through the space created with a standard casing bead. Another embodiment utilizes an extended edge on the lower surface of the drainage cavity to create a surface for a traditional casing bead to seat providing a consistent space for vapor and moisture to escape. Embodiments of this invention also allow for construction practices where the rain screen extends up into the soffit area for further exhausting of vapor and moisture to escape through to the plenum and ultimately to release through a roof vent. Embodiments of this invention can be incorporated into new construction or the remediation of worn or deficient walls of stucco, manufactured stone or continuous insulation. FIG. 1 depicts a perspective of the device with a ventilation screed and an attachment flange with nailing holes that is vertical to the building wall. FIG. 1 illustrates this embodiment is perforated with openings for the attachment with a code approved mechanical fastener and for the keying of finish, which may be cementitious or acrylic in nature. FIG. 1 depicts an embodiment that is attached on top of and through rainscreen, sheathing and water resistant barrier at the top of wall directly under the soffit. Pressing the Water Seal snugly and compressing slightly to provide a water resistant seal. During settling or loading of the structure the gasket will allow for minor movement. FIG. 1 depicts embodiment with "connector" accessory to facilitate the straight, true and continuous installation of this invention FIG. 2 depicts the device in section in a basic preferred embodiment. FIG. 4 depicts an embodiment with a standard casing bead attached directly below and touching the extended spacer edge creating the exterior opening of the wall. The casing bead provides an additional smooth edge stop for the stucco finish. FIG. 7 depicts multiple sections of an embodiment for a one-piece, semi-rigid or a flexible plastic, polymer or other non-metallic gasket. The gasket may have a self-stick adhesive surface. As shown the ventilation screen has a drainage cavity (140), ventilation openings (142), ventilation spacer (144), moisture seal (138), attachment flange (146), attachment holes (150) and a traditional casing bead (148). Note the term moisture seal and water seal refer to the same thing which may be a gasket. The ventilation spacer maintains a more consistently defined space for vapor and moisture to escape the building. FIGS. 9 and 10 depict the slotted openings in the base of the Drainage Cavity. The present invention can be fabricated from a plurality of materials with consideration given to the specific requirements for different building envelope systems and construction practices. The present invention can be made of plastic, polymer or other non-metallic material, resistant to rusting and deterioration in moisture and salt or caustic environments as well as metal materials, metal alloy materials or composite materials. The present invention can address the unique needs and considerations for framed/sheathed walls, masonry and concrete masonry unit assemblies that can incorporate exterior finishes over a lathing substrate; manufactured stone over lathing substrate, various thicknesses of continuous thermal exterior insulation; wood or manmade siding; and metal panels both with and without insulation. The present invention is intended to be compatible with all types of substrates and materials e.g. carbon steel, stainless, non-metallic expanded metal, woven wire, welded wire and non-metallic lath. This device may be factory or job fitted to any type of stucco casing bead or to create a control joint with back to back casing beads. No control joint is available when the two adjacent stucco panels are of a different thickness.

As the invention has been described, it will be apparent to those skilled in the art that the same may be varied in many ways without departing from the spirit and scope of the invention. Any and all such modifications are intended to be included within the scope of the appended claims.

In the preceding description, for purposes of explanation and not limitation, specific details are set forth (such as particular structures, components, techniques, etc.) in order to provide a thorough understanding of the disclosed fencing system. However, it will be apparent to those skilled in the art that the disclosed system may be constructed in other embodiments that depart from these specific details. That is, those skilled in the art will be able to devise various arrangements which, although not explicitly described or shown herein, embody the principles of the disclosed system. In some instances, detailed descriptions of well-known components and construction methods are omitted so as not to obscure the description of the disclosed system with unnecessary detail. All statements herein reciting principles, aspects, and embodiments of the disclosed system, as well as specific examples thereof, are intended to encompass both structural and functional equivalents thereof. Additionally, it is intended that such equivalents include both currently known equivalents as well as equivalents developed in the future, such as, for example, any elements developed that perform the same function, regardless of structure.

As will be recognized by those skilled in the art, the innovative concepts described in the present application can be modified and varied over a wide range of applications. Accordingly, the scope of patented subject matter should not be limited to any of the specific exemplary teachings discussed above, but is instead defined by the following claims.

What is claimed is:

1. A ventilation screed configured to be mounted at a vertical wall of a structure, the ventilation screed comprising:

a perforated attachment flange that, with the ventilation screed mounted at the vertical wall of the structure, is substantially vertical and has an upper portion and a lower portion and at least one perforation between the upper portion and the lower portion;

a three sided cavity structure disposed along the upper portion of the perforated attachment flange and having (i) a first side that, with the ventilation screed mounted at the vertical wall of the structure, is substantially horizontal and that has an attaching portion and a distal portion distal from the attaching portion, (ii) a second side that, with the ventilation screed mounted at the vertical wall of the structure, is substantially vertical and that has a top portion in communication with the attaching portion of the first side, the second side being at a substantially 90 degree angle to the first side, and (iii) a third side that is between a bottom portion of the second side and the upper portion of the perforated attachment flange at an angle that slopes downwardly from the upper portion of the perforated attachment flange toward the bottom portion of the second side, wherein the third side has at least one ventilation opening, and wherein there is a gap between the distal portion of the first side and the upper portion of the perforated attachment flange;

wherein the gap between the distal portion of the first side and the upper portion of the perforated attachment flange that comprises an opening entirely along the three sided cavity structure and that is devoid of any structure connecting between the distal portion of the first side and the upper portion of the perforated attachment flange; and a ventilation spacer along and extending downward from an underside of the third side of the three sided cavity structure when the ventilation screed is mounted at the vertical wall of the structure, wherein the ventilation spacer protrudes from the third side at a location that is between the upper portion of the perforated attachment flange and the bottom portion of the second side and that is spaced from the bottom portion of the second side.

2. A ventilation screed as in claim 1, wherein the ventilation screed is configured to be connected to second adjacent ventilation screed via a connector, and wherein the connector is partially received in the three sided cavity structure of the ventilation screed.

3. A ventilation screed as in claim 2, wherein the connector is a three sided connector that is smaller than the three sided cavity structure and is received in the three sided cavity structure to connect the ventilation screed to the second adjacent ventilation screed.

4. A ventilation screed as in claim 1, further comprising a moisture seal attached along an upper surface at the attaching portion of the first side of the three sided cavity structure.

5. A ventilation screen as in claim 1, wherein the at least one perforation of the perforated attachment flange comprises three rows of circular openings.

6. A ventilation screed as in claim 1, wherein, with the ventilation screed mounted at the vertical wall of the structure, a portion of the ventilation spacer and a portion of the perforated attachment flange are in communication with a casing bead.

7. A ventilation screed as in claim 1, wherein, with the ventilation screed mounted at the vertical wall of the structure, a screen is disposed parallel to at least a portion of the perforated attachment flange.

8. A ventilation screed as in claim 1, wherein, with the ventilation screed mounted at the vertical wall of the structure, a mesh is disposed parallel to at least a portion of the perforated attachment flange.

9. A ventilation screed as in claim 1, wherein, with the ventilation screed mounted at the vertical wall of the structure, a reticulated foam insert is installed parallel to and between the vertical wall and the perforated attachment flange.

10. A ventilation screed as in claim 1, wherein the ventilation screed is configured to be connected to a second adjacent ventilation screed via a joint connector disposed at a connection of at least one of (i) the first side and the second side, (ii) the second side and the third side, and (iii) the third side and the perforated attachment flange.

11. A ventilation screed assembly configured to be mounted at a vertical wall of a structure, the ventilation screed assembly comprising:

at least two ventilation screeds, each of the at least two ventilation screeds comprising:

a perforated attachment flange that, with the ventilation screed assembly mounted at a vertical wall of the structure, is substantially vertical and has an upper portion and a lower portion and at least one perforation between the upper portion and the lower portion;

a three sided cavity structure disposed along the upper portion of the perforated attachment flange and having (i) a first side that, with the ventilation screed mounted at the vertical wall of the structure, is substantially horizontal and that has an attaching portion and a distal portion distal from the attaching portion, (ii) a second side that, with the ventilation screed mounted at the vertical wall of the structure, is substantially vertical and that has a top portion in communication with the attaching portion of the first side that is at a substantially 90 degree angle to the first side, and (iii) a third side that is between a bottom portion of the second side and the upper portion of the perforated attachment flange at an angle that slopes downwardly from the upper portion of the perforated attachment flange toward the bottom portion of the second side, wherein the third side has at least one ventilation opening, and wherein there is a gap between the distal portion of the first side and the upper portion of the perforated attachment flange;

wherein the gap between the distal portion of the first side and the upper portion of the perforated attachment flange comprises an opening entirely along the three sided cavity structure and is devoid of any structure connecting between the distal portion of the first side and the upper portion of the perforated attachment flange; and a ventilation spacer along and extending downward from an underside of the third side of the three sided cavity structure when the ventilation screed is mounted at the vertical wall of the structure, wherein the ventilation spacer protrudes from the third side at a location that is between the upper portion of the perforated attachment flange and the bottom portion of the second side and that is spaced from the bottom portion of the second side; and a connector connecting adjacent ones of the at least two ventilation screeds.

12. A ventilation screed assembly as in claim 11, wherein the connector is a three sided connector that is smaller than the three sided cavity structures of the at least two ventilation screeds and is partially received in the three sided cavity structure of each of the connected adjacent ventilation screeds.

13. A ventilation screed assembly as in claim 11, further comprising a moisture seal attached along an upper surface at the attaching portion of the first side of the three sided cavity structure.

14. A ventilation screed assembly as in claim 13, wherein the at least one perforation of the perforated attachment flange comprises three rows of circular openings.

15. A ventilation screed assembly as in claim 11, wherein, with the ventilation screed mounted at the vertical wall of the structure, a distal portion of the ventilation spacer distal from the third side and a portion of the perforated attachment flange are in communication with a casing bead.

16. A ventilation screed assembly as in claim 11, further comprising a screen that, with the ventilation screed mounted at the vertical wall of the structure, is parallel to at least a portion of the perforated attachment flange.

17. A ventilation screed assembly as in claim 11, further comprising a mesh that, with the ventilation screed mounted at the vertical wall of the structure, is parallel to at least a portion of the perforated attachment flange.

18. A ventilation screed assembly as in claim 11, further comprising a reticulated foam insert that, with the ventilation screed mounted at the vertical wall of the structure, is parallel to and between the vertical wall and the perforated attachment flange.

19. A ventilation screed assembly as in claim 11, wherein the connector is disposed at a connection of at least one of (i) the first side and the second side, (ii) the second side and the third side, and (iii) the third side and the perforated attachment flange.

* * * * *